US006575807B2

(12) United States Patent
Spector

(10) Patent No.: US 6,575,807 B2
(45) Date of Patent: Jun. 10, 2003

(54) ANIMATED, FOAM FILLED TOY FIGURE

(76) Inventor: Donald Spector, 380 Mountain Rd., Union City, NJ (US) 07087

( * ) Notice: Subject to any disclaimer, the term of this patent is extended or adjusted under 35 U.S.C. 154(b) by 0 days.

(21) Appl. No.: 09/891,071

(22) Filed: Jun. 25, 2001

(65) Prior Publication Data

US 2001/0034178 A1 Oct. 25, 2001

Related U.S. Application Data

(63) Continuation-in-part of application No. 09/129,991, filed on Aug. 6, 1998, now Pat. No. 5,961,963, which is a continuation-in-part of application No. 09/074,871, filed on May 8, 1998, now Pat. No. 5,897,418.

(51) Int. Cl.[7] ..... A63H 3/36; A63H 3/00

(52) U.S. Cl. ..... 446/320; 446/385; 446/369; 446/368

(58) Field of Search ..... 446/73, 75, 76, 446/81, 268, 368, 435, 385, 320; 473/596

(56) References Cited

U.S. PATENT DOCUMENTS

| | | | | | |
|---|---|---|---|---|---|
| 202,990 | A | * | 4/1878 | Chinnock | 446/311 |
| 2,224,456 | A | * | 12/1940 | Janas | 446/300 |
| 2,564,813 | A | * | 8/1951 | Moyers | 223/68 |
| 2,760,302 | A | * | 8/1956 | Cheskin | 124/79 |
| 3,091,053 | A | * | 5/1963 | Growald | 446/14 |
| 3,354,578 | A | * | 11/1967 | Ryan | 156/212 |
| 3,607,491 | A | * | 9/1971 | Brown | 156/77 |
| 4,881,915 | A | * | 11/1989 | Liaw | 428/16 |
| 4,936,460 | A | * | 6/1990 | Meyer | 206/524.8 |
| 5,316,689 | A | * | 5/1994 | Farrell | 446/153 |
| 5,885,128 | A | * | 3/1999 | Blaustein et al. | 446/369 |
| 5,895,308 | A | * | 4/1999 | Spector | 446/183 |
| 5,897,418 | A | * | 4/1999 | Spector | 206/457 |
| 5,913,708 | A | * | 6/1999 | Gross | 446/183 |
| 5,961,363 | A | * | 10/1999 | Spector | 446/368 |
| 6,155,904 | A | * | 12/2000 | Spector | 446/311 |
| 6,234,858 | B1 | * | 5/2001 | Nix | 446/101 |
| 6,261,146 | B1 | * | 7/2001 | Spector | 446/385 |
| 6,264,526 | B1 | * | 7/2001 | Meeker | 446/369 |

* cited by examiner

*Primary Examiner*—Derris H. Banks
*Assistant Examiner*—Dmitry Suhol
(74) *Attorney, Agent, or Firm*—Mitchell A. Stein; Stein Law, P.C.

(57) ABSTRACT

A compressible figure form which includes an air permeable skin and a compressible resilient foam core, wherein the compressible resilient foam core includes resilient mechanical means within a cavity within said core. The resilient mechanical means is comprised of a material or configuration of material which is both more resistant to compression than the foam core and more resilient to expansion than the foam core. Thus, the compressible figure can be readily compacted by compression thereof into a compact form. Unlike traditional compressible figure forms, the release of the compressive forces thereon results in a rapid and unexpected expansion of the mechanical means within the figure, and thereby the full extension of the figure form. The combined effect of the expansion of the resilient foam body and the mechanical means within the figure causes increased animation (action) in the deployment/expansion of the figure form in comparison to the prior art, and effectively transforms what has traditionally been regarded as a relatively passive process into a dynamic recoil from the compressed to the fully expanded figure form.

2 Claims, 3 Drawing Sheets

ANIMATED, FOAM FILLED TOY FIGURE

CROSS-REFERENCE TO RELATED APPLICATIONS

This application is a continuation-in-part of commonly assigned Spector application, Ser. No. 09/129,991, filed Aug. 6, 1998, entitled Package Containing Shrunken Figure, now U.S. Pat. No. 5,961,963 which in turn was a continuation-in-part of application, commonly assigned Spector application, Ser. No. 09/074,871, filed May 8, 1998, entitled Test Tube Doll Package, now U.S. Pat. No. 5,897,418, issued Apr. 7, 1999.

FIELD OF THE INVENTION

This invention relates to a device and to a method. More specifically, this invention relates to a compressible toy object and to a method for imparting animation to such toy by incorporation therein of a mechanical energy storage means.

DESCRIPTION OF THE PRIOR ART

The use of animation to increase interest in toys is common-place; and, has been utilized in a number of children's toys, such as the Jack In Box, dolls that undergo changes in their body contours (U.S. Pat. No. 5,664,983 to Hollis), books with so-called "pop-up" figures or structures (U.S. Pat. No. 5,681,199 to Morris), and various and sundry other playthings of various sizes, shapes and appeal. Particularly popular among children are transformative figure toys which include body shape and/or appearance-changing components that may be selectively manipulated by the child. The shape-changing components may simulate, for example, pregnancy (U.S. Pat. No. 3,812,613, to Glass et. al., and U.S. Pat. No. 4,183,171, to Terzian); weight gain/loss (U.S. Pat. No. 5,167,561, to Rizzo, and U.S. Pat. No. 5,419,729, to Gross); maturity (U.S. Pat. No. 3,992,807, to Sapkus et. al., and U.S. Pat. No. 3,995,394, to Ayton), and; muscular development (U.S. Pat. No. 3,731,426, to Lewis et. al. as well as the aforementioned patent to Gross).

In a number of these contrivances, the animation can be imparted by simply release of a compressed or contained figure from a confining environment and allowing it to expand (U.S. Pat. No. 5,897,418 to Spector); or, alternatively, by a mechanical mechanism which is activated by movement of one or more of the limbs of the figure (U.S. Pat. 5,664,983 to Hollis).

Notwithstanding, the prior art creativity in imparting changes in toy figure contours and shapes, the means for achievement of such changes often make such toys difficult to fabricate and expensive; and, thus, impractical. Accordingly, figures formed of compressible materials which can be compressed and thereafter released, remain both popular, practical to manufacture and, thus, more affordable. The cost sensitivity of such figures is of particular significance when such items are give-aways or promotional items. Because of the processes involved in the compression and expansion of such devices, the animation or action value of figures incorporating such materials is limited and relatively conservative when compared to more animate figures and objects. Accordingly, there is a need to devise a system for a compression figure which preserves the desirable features thereof relative to each of fabrication and economy of manufacture and yet imparts more dynamic action or movement to the device that simple expansion thereof alone.

OBJECTS OF THE INVENTION

It is the object of this invention to remedy the above and related deficiencies in the prior art.

More specifically, it is the principle object of this invention to provide a compressible play toy having a combination of mechanical features to enhance animation thereof.

It is another object of this invention to provide a compressible play toy wherein the body thereof comprises both a resilient foam and a mechanism for increasing the resiliency of the foam.

It is yet another object of this invention to provide a compressible play toy wherein the body thereof includes a hollow cavity for housing a mechanism for increasing the resiliency of the foam components thereof.

SUMMARY OF THE INVENTION

The above and related objects are achieved by providing a compressible figure form which includes an air permeable skin and a compressible resilient foam core, wherein the compressible resilient foam core includes resilient mechanical means within a cavity within said core. The resilient mechanical means is comprised of a material or configuration of material which is both more resistant to compression than the foam core and more resilient than the foam core. Thus, the compressible figure can be readily compacted by compression thereof into a compact form. Unlike traditional compressible figure forms, the release of the compressive forces thereon results in a rapid and unexpected expansion of the mechanical means within the figure, and thereby the full extension of the figure form along one of its principle dimensions (e.g. height). The combined effect of the expansion of the resilient foam body and the mechanical means within the figure causes increased animation (action) in the deployment/expansion of the figure form in comparison to the prior art, and effectively transforms what has traditionally been regarded as a relatively passive process into a dynamic recoil from the compressed to the fully expanded figure form.

DETAILED DESCRIPTION

Figure 1:
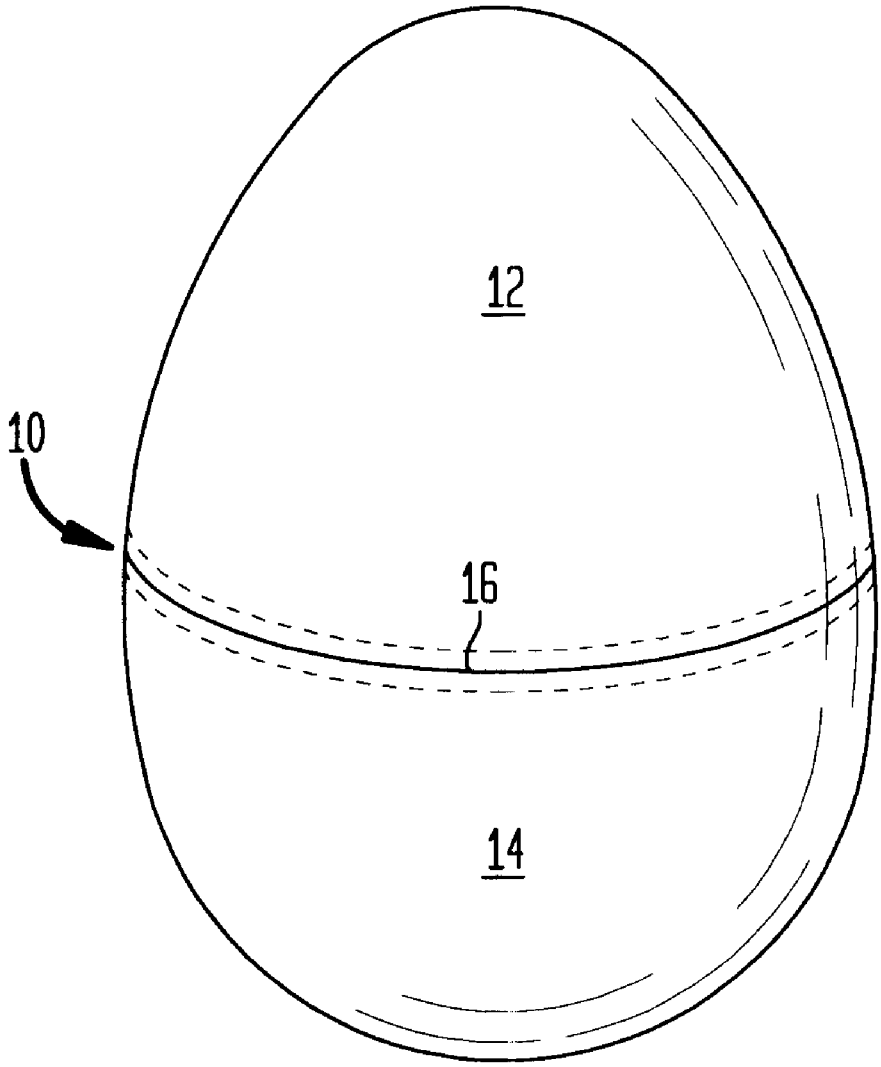
FIG. 1 depicts a toy figure of this invention compressed within a container.

The action figure of this invention is depicted in the Figures which accompany this application. Where an element is present in more than one of these Figures, its is assigned a common reference numeral for continuity of expression and ease of understanding.

Figure 2:
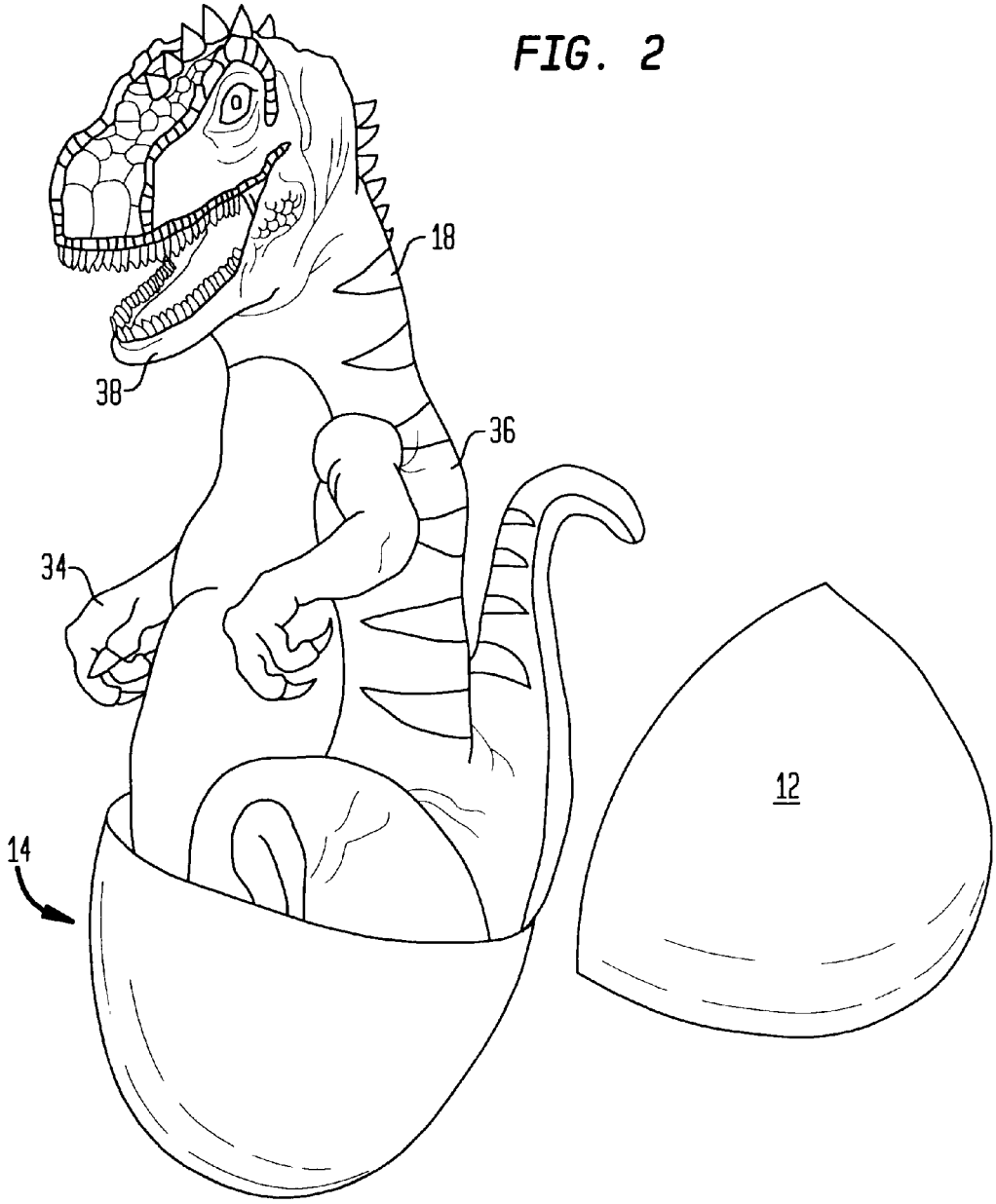
FIG. 2 depicts a toy figure of FIG. 1 wherein the figure is released from its container.

FIGS. 1 & 2 depict a representative embodiment of an action figure (18) within the contemplation of the concept of this invention. More specifically, a container (10) in the form of an egg or capsule is shown wherein an compressible action figure (18) is stored therein. This container (10) or capsule is shown in the closed or locked position. The embodiment of the invention depicted in FIG. 1 includes a container (10) of approximately two equal and complimentary sections (12, 14) joined together at the mid-line (16) of the assembly. Each section (12, 14) releasably engages the other by means of friction-fit features that are molded into the overlapping margins of each. Alternatively, the engagement of the two sections can be through a screw-thread arrangement (not shown) wherein one section engages the other in the same manner as a nut and bolt engage one another.

Figure 3:
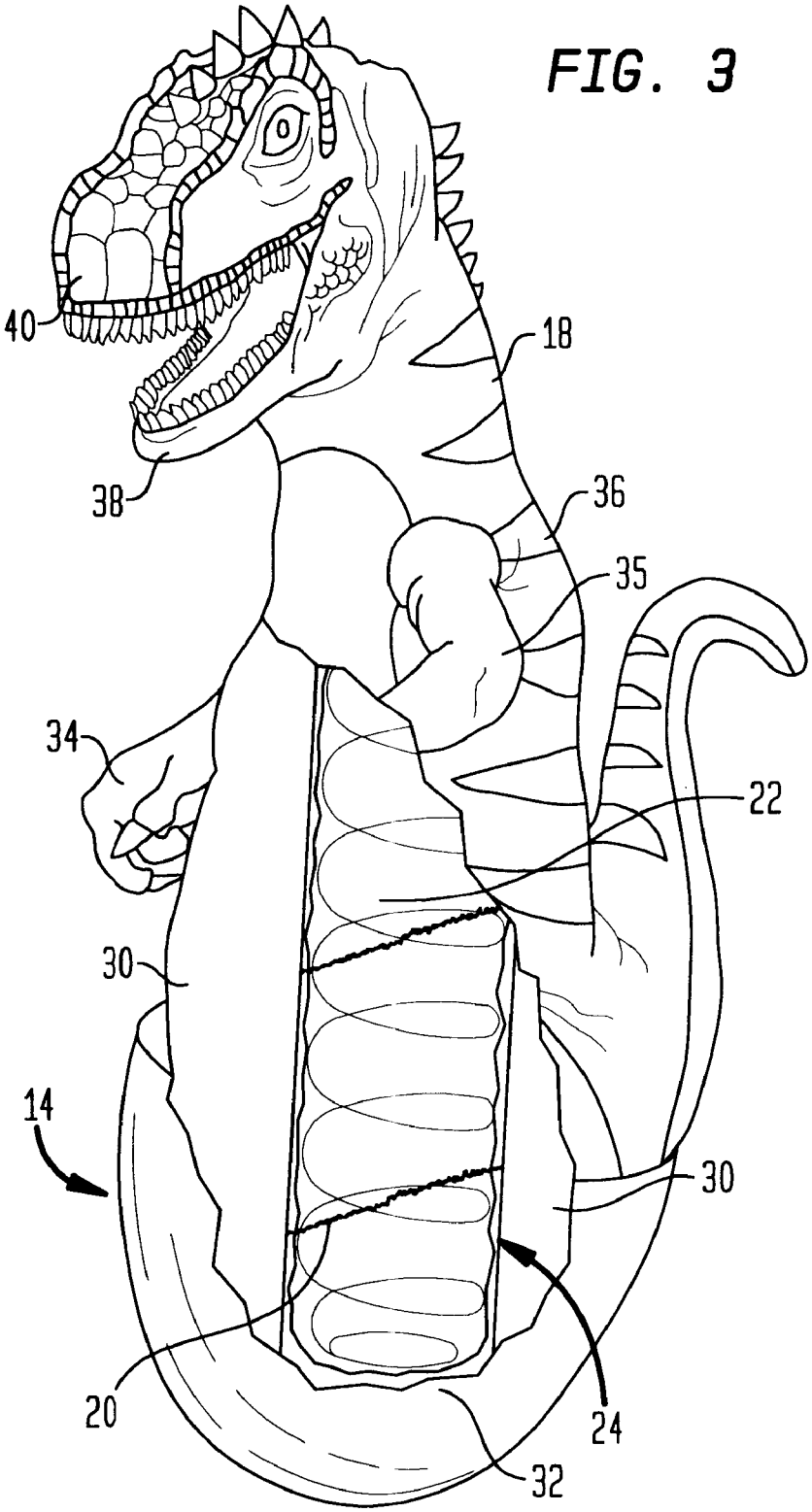
FIG. 3 is an exploded view, in partial section, of the figure of FIG. 2.

One the container is opened, the compressed figure (18) is rapidly enlarged to its ful height by means of an internal module/mechanical mechanism (20) (more fully described in reference to FIG. 3). As shown in FIG. 3 this module (20) can take the form of an accordion-like or spiral wound spring (22) located within a cavity (24) of the action figure (18). In the preferred embodiments of this invention, the module (20) is separately manufactured and inserted into the cavity (24) of the action figure as a self-contained unit. This module (20) comprises a compressible container which includes a mechanical spring (22), and, preferably, means for attachment of the spring (not shown), within the module (20), to the interior surface of the compressible container so as to insure coincident expansion of the spring (22) and the module (20). This module (20) is also preferably configured to be anchored to the core material (30) at one or more locations relative to the interior of the chamber (24) within the action figure (18) to guide the expansion thereof in the desired direction. Such guidance can be molded into the core materials (30) which fills the figure (18), or by some other independent means (not shown).

In one of the preferred embodiments of this invention, the core (30) of the action figure (18) is molded with a open cavity (24) in the base (32) thereof, and module (20) inserted into the core (30) through this opening (not shown) in the base (32) of the figure (18). The core materials (30) suitable for use in this invention are well-known to one skilled in the art and can include any compressible and expandable materials traditionally utilized in the fabrication of toys or novelty items. The skin (36) of the action figure (18) can be fabricated from any breathable natural or synthetic material, specifically, a material that is durable enough to undergo repeated compression and expansion of the action figure (18). In one of the preferred embodiments of this invention, the skin is rotationally cast from a poromeric resin (e.g. Corfam™, available form E.I. DuPont DeNemours Company, Wilmington, Del.) wherein the breathability thereof is tailored/engineered to accommodate a pre-set rate of transmission/diffusion of air through the skin incident to compression and expansion of the action figure.

In order to provide consistent and uniform expansion, its is also preferable to provide means for adhering the surface of the module (20) within the open cavity (24) of the core material (30). This can be achieved through the use of adhesives, sonic welding and the like. The adherence of the module (20) to the core (30) reduces mechanical abrasion of the core upon repeated compression and expansion of the mechanical mechanism.

In practice, the action figure (18) is packaged within a decorative container, and the container sealed with a releasable fastener. Once this releasable fastener is opened and the two sections of the container parted, the action figure is rapidly deployed. As noted and once again emphasized, the preferred embodiments of this invention include not only a mechanical mechanism for rapid erection of the torso of the figure, but also preferably core materials (30) having differential rates of expansion. More specifically, once the initial erection of the action figure has been rapidly effected, the appendages (34, 35) and facial features (38, 40) remain at least partial compressed. Thereafter, the appendages (34, 35) and facial features (38, 40) gradually take form through expansion of the core material (30) below the figure's "skin" (36). This differential expansion of the action figure gives the appearance of an awakening of an animate creature, wherein the progressive release and expansion of the creature's appendages (34, 36) and facial features (38, 40) more closely resembles the movements of an animate figure. The differential expansion can also be provided by a combination of core materials for the torso, the appendages and facial features, and/or, alternatively, differential permeability of the figures "skin" in each of these areas. More specifically, depending upon the nature of the core materials selected for a given anatomical feature/appendage, the amount of compression and rate of expansion can be varied. Moreover, such modulation can also be controlled through the progressive inflation of the compressed materials through control of foam density and/or the permeability of the surrounding skin of the figure.

In either case, the preferred action figures of this invention, have both rapid and progressive movement by means of combinations of core materials which control its inflation rate or through modulation of the rate of air filling the voids within the compressed figure.

What is claimed is:

1. A compressible, shaped figure compacted by compression into a compact form and contained within an egg-shaped container, said figure comprising:

an air permeable skin in the shape of a figure;

a core material comprising at least two different compressible and expandable foams, wherein each of said foams expands at different rates after being decompressed, said core material filling the air permeable skin and occupying the interior portion of the said figure and thereby providing an essentially fully inflated figure upon decompression and expansion thereof when released from said container;

an internal cavity disposed within said core material for housing an expansion module;

said expansion module being disposed within said internal cavity and comprising a compressible mechanism that is readily compressible and expandable; and said expansion module being compressible upon compression of said figure, and aids the expansion of the figure upon expansion of the expansion module when released from said container.

2. The compressible figure of claim 1, wherein said expansion module is physically attached at one or more locations within said internal cavity of said cure, so as to compress and expand, coincident with said core.

* * * * *